US009627756B2

(12) United States Patent
Richeson

(10) Patent No.: US 9,627,756 B2
(45) Date of Patent: Apr. 18, 2017

(54) INTERLACED ELEMENT UHF/VHF/FM ANTENNA

(71) Applicant: John William Richeson, Chula Vista, CA (US)

(72) Inventor: John William Richeson, Chula Vista, CA (US)

( * ) Notice: Subject to any disclaimer, the term of this patent is extended or adjusted under 35 U.S.C. 154(b) by 241 days.

(21) Appl. No.: 14/500,995

(22) Filed: Sep. 29, 2014

(65) Prior Publication Data

US 2016/0093946 A1 Mar. 31, 2016

(51) Int. Cl.
*H01Q 1/36* (2006.01)
*H01Q 5/364* (2015.01)

(52) U.S. Cl.
CPC ..... *H01Q 5/364* (2015.01)

(58) Field of Classification Search
CPC ..... H01Q 1/36; H01Q 1/50
See application file for complete search history.

(56) References Cited

U.S. PATENT DOCUMENTS 4,833,483 A * 5/1989 Newcomb ..... H01Q 9/32 343/722
5,701,130 A * 12/1997 Thill ..... H01Q 1/36 343/742
6,300,920 B1 * 10/2001 Pertl ..... H01Q 7/00 343/742
7,079,079 B2 * 7/2006 Jo ..... H01Q 1/243 343/700 MS
8,736,500 B1 * 5/2014 Lam ..... H01P 5/10 343/726
2009/0146899 A1 * 6/2009 Schneider ..... H01Q 19/10 343/834
2015/0318612 A1 * 11/2015 Karlsson ..... H01Q 7/00 343/852

* cited by examiner

*Primary Examiner* — Dameon E Levi
*Assistant Examiner* — Hasan Islam

(57) ABSTRACT

A UHF/VHF/FM antenna consisting of two elongated octagonal elements formed individually from ¼" O.D. (Outer Dimension) flexible copper tubing, interlaced with each other before coupling of the open tubing ends, then concentrically aligned perpendicular to each other, and soldered at a interlacing cross points. Signals received by the interlaced elements are directed to a 300-75 ohm transformer balun through two bare 12-guage copper wires, each bent approximately 90°, then soldered to the mid-points of adjacent element short sides and perpendicular element cross points.

1 Claim, 1 Drawing Sheet

INTERLACED ELEMENT UHF/VHF/FM ANTENNA

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION (A) Field of the Invention

This invention relates to the field of RF antennas for receiving over-the-air broadcasts of television and radio signals in the spectrum assigned by the FCC to UHF, VHF, and FM broadcasts.

(B) Discussion of the Background

The science of RF antennas is well established, with over-the-air broadcasting having been the predominant source of audio and video content for American consumers through the 1960s and 1970s. During the final quarter of the $20^{th}$ century, however, cable television providers came to dominate the distribution of video content, and with the proliferation of broadband and mobile services into the $21^{st}$ century, the historical allotment of spectrum to over-the-air broadcasting could no longer be justified.

The first move to reallocate broadcast spectrum to new uses came in 2005, when Congress passed a law to force the television industry to switch from analog to digital signals within a narrower band of RF spectrum by 2009. Implementation of this law by the FCC resulted in a proliferation of channels in the narrower UHF spectrum, and this was a major disrupter to the antenna industry. Since UHF signals require smaller antenna elements than VHF signals, a wide variety of smaller omnidirectional indoor and outdoor antennas came to market, and with their high definition digital video, they spawned a cult-like movement of "cord cutters" who were seeking relief from the increasing costs of cable television services.

The small indoor antennas also became popular within the growing population of renters (approaching 40% of the U.S. population according to the latest census data), on whom costly cable TV subscriptions can be especially burdensome, while they have limited access to rooftop and attic spaces for installing antennas, and face restrictions on running antenna cables through walls and common areas.

Then in 2012, Congress passed another law to reallocate the upper UHF spectrum that TV broadcasters had just filled with digital signals, to mobile telecom. Under rules promulgated by the FCC in 2014 pursuant to the law, broadcasters in the 600-698 Mhz band will be forced into lower UHF frequencies or moved down to VLF frequencies (or will cease broadcasting) by 2018.

While it is hard to argue with priority for scarce spectrum being reassigned to mobile telecom from broadcast television, the planned spectrum reallocation will create another major disruption in the antenna industry, and especially for users of the new generation of smaller omnidirectional antennas. A substantial number of these antennas will become obsolete, and replacing them with the large, mast-mounted outdoor antennas historically used for VHF television reception, will simply not be possible for the growing population of renters.

The laws of physics relative to RF signals cannot be broken, but an alternative is needed for "cord cutters" and renters to be able to continue enjoying high definition over-the-air broadcasts through the next round of spectrum reallocation, and not be forced into high cost cable services—or having to forgo television services all together.

BRIEF SUMMARY OF THE INVENTION

This antenna consists of two elongated octagonal elements formed individually from ¼" O.D. (Outer Dimension) flexible copper tubing, interlaced with each other before coupling of the open tubing ends, then concentrically aligned perpendicular to each other, and soldered at all interlacing cross points. Signals received by the interlaced elements are directed to a balun through two bare 12-guage copper wires, each bent approximately 90°, then soldered to the mid-points of adjacent element short Sides and perpendicular element cross points.

A prototype of this antenna (weighing approximately 1 lb. and measuring approximately 24"×24"×½") received steady-state signals (19 db or greater SNR and IF-AGC less than 60) from all stations in the green, yellow and red color bands as shown on the TVfool.com digital signal analysis for the prototype test location. It also received 36 (29 static-free) 88.7-107.7 Mhz FM stations. The TV stations consisted of 2 high VHF and 1 UHF station with broadcast towers 20 miles northwest, 1 UHF station each 13 and 30 miles southeast, and multiple UHF stations 7 miles northeast and 9 miles south of the test location. During the tests, the prototype antenna was hung on the north side roof overhang of a one-floor house in hilly terrain with a screw hook, the antenna coax cable was attached unamplified to the lead-in coax formerly used for cable television service to the house, and the locked SNR/AGC results were noted on the tuner displays of television sets attached to internal wall cable outlets.

Although the impact on local broadcasters of the planned reallocation of UHF broadcast spectrum to mobile telecom will not be known until late 2015, the prototype results indicate that the impact on users of this antenna should be limited to having to periodically rescan channels as lower spectrum broadcast towers come on line.

DETAILED DESCRIPTION OF THE INVENTION

The linear dimensions in this specification and accompanying drawings are prototypical, and are not intended to limit the claimed design and fabrication method.

Figure 1:
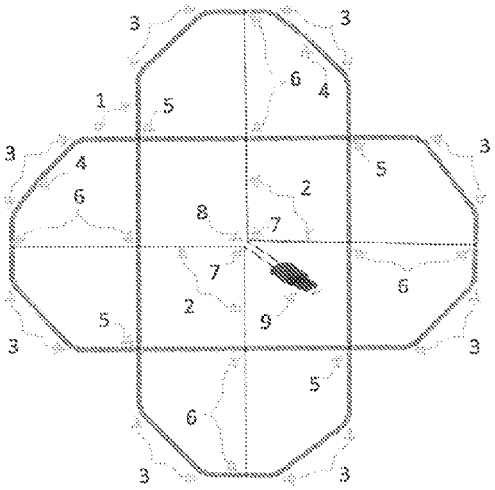
FIG. 1 is a full frontal perspective of the finished antenna, showing the relationships and fabrication methods of its various components.
Figure 3:
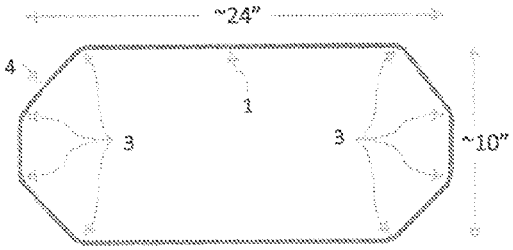
FIG. 3 is a detailed view of the antenna elements embodied in the finished antenna of FIG. 1, including prototypical dimensions used for performance testing.

The FIG. 1 antenna is fabricated from ¼" O.D. copper tubing 1 and bare 12-guage copper wire 2. A 60" piece of copper tubing is used to form each of the FIG. 3 elongated octagonal elements by starting at coupling point 4, then bending the tubing using a bending tool or custom fixture to form a rounded 45° corner 3 at the 2", 20", 24", 28", 32", 50", 54", and 58" marks, leaving the tubing-ends to be coupled 4 once the two elements have been interlaced. The tubing is not to be crimped during bending.

Figure 2:
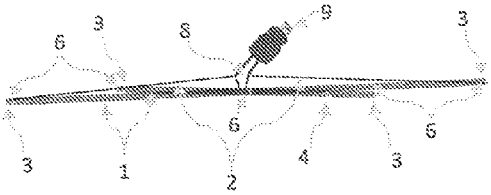
FIG. 2 is a top/side view of the finished antenna of FIG. 1, showing the relationships and fabrication methods of its various components.

FIG. 2 shows the interlacing of the two separately-formed elements, with the long sides of each element passing over or under opposing long sides of the other element. This interlacing creates a vertical separation of the tubing ends at the coupling 4 point on each element, which is closed by slightly bending the tubing over the interlacing element to align the ends, joining them, and soldering them together.

Once the couplings 4 have been soldered, the finished elements are concentrically aligned perpendicular to each other and all interlacing cross-points 5 are soldered.

Figure 4:
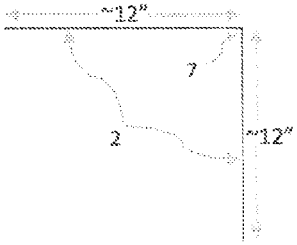
FIG. 4 is a detailed view of the signal collector embodied in the finished antenna of FIG. 1, including prototypical dimensions consistent with FIG. 3 elements used for performance testing.

A 24" piece of bare 12-guage copper wire 2 is used to form each FIG. 4 signal collector. Each wire is bent at its center to approximately a 90° angle 7 and the bend points centered on the FIG I antenna such that an approximate ½" gap 8 is present between the two collectors in the center of the antenna, and the wire ends extend to the mid-points of adjacent short sides of each element as shown in FIG. 1.

Once both FIG. 4 signal collectors 2 are aligned, all cross-points between elements and collectors 6 are soldered, and if any we extends outside an element, the extending wire is trimmed and filed until smooth.

The final fabrication step is to solder an outdoor-rated 300-75 ohm UHF/VHF/FM transformer balun 9 to the collectors 2 at bend points 7 in the center of the antenna, The balun is not part of this invention and is sourced as a completed product for incorporation into the antenna.

The invention claimed is:

1. An antenna having two loop elements, each fabricated from approximately 60" of ¼" copper tubing formed into elongated octagons through rounded 45° bends applied at approximately the 2", 20", 24", 28", 32", 50", 54", and 58" marks, that are interlaced and aligned perpendicularly and concentrically in the same plane before coupling of the tubing ends, then further connected by two approximately 24" lengths of bare 12-gauge copper wire, each bent approximately 90° at their centers, and fastened along the mid-line of said elements to their respective transverse and far end segments, such that an approximate ½" gap remains between the 90° wire bend points at the center of the antenna for attaching a balun.

* * * * *